US005632648A

United States Patent [19]

Liu

[11] Patent Number: 5,632,648

[45] Date of Patent: May 27, 1997

[54] ADAPTER FIXING DEVICE

[75] Inventor: Danny Liu, Hsin-Tien, Taiwan

[73] Assignee: Dan-Chief Enterprise Co., Ltd., Hsin-Tien, Taiwan

[21] Appl. No.: 425,946

[22] Filed: Apr. 19, 1995

[51] Int. Cl.[6] ..... H01R 13/74

[52] U.S. Cl. ..... 439/550; 439/544

[58] Field of Search ..... 439/544, 550, 439/552, 553, 554, 557, 562, 565

[56] References Cited

U.S. PATENT DOCUMENTS 3,643,132 2/1972 Odmark ..... 439/552

*Primary Examiner*—Gary F. Paumen

[57] ABSTRACT

An adapter fixing device configured to fix an adapter on a panel comprises an upper member held attached to the panel, a lower member coupled with the upper member for fixing therebetween the adapter, and an engaging device combining together the upper member and the lower member. The present invention not only engages an adapter to a wire collecting frame but costs less than other device using the prior art does. The design of the present invention reduces the use of screws or even abandons screws which lowers the chance of losing screws. People skilled in the art will readily appreciate the design.

19 Claims, 9 Drawing Sheets

ADAPTER FIXING DEVICE

FIELD OF INVENTION

The present invention is related to an adapter fixing device, and more particularly to a fixing device for telephone or computer network adapter.

BACKGROUND OF INVENTION

It is known in prior art that an adapter is directly screwed on a wire collecting frame, referring to FIG. 1. Four screws 111, 112, 113, 114 coupled with four metal cylinder screw holes 131, 132, 133, 134 on the wire collecting frame 12 lock the adapter 10 to the wire collecting frame 12, where the wire collecting frame 12 is made of metal and the four metal cylinder screw holes 131, 132, 133, 134 are locked to the wire collecting frame 12 with screws 141, 142, 143, 144.

FIG. 2 shows another fixing device known in prior art where a top cap 21 covers and is fastened with the adapter 20 by screwing the screws 221, 222 to the screw hole seat 211, 212 on the top cap 21 through the screw holes 201, 202 on the adapter 20. Then the adapter 20 and the top cap 21 are secured to the wire collecting frame 23 with the screws 241, 242, 243, 244 screwed to the screw holes 231, 232, 233, 234 on the wire collecting frame 23 and the screw holes 213, 214, 215, 216 on the top cap 21.

As seen from FIGS. 1 and 2, eight and six screws are respectively required and the assembly in FIG. 1 additionally needs four metal cylinder screw holes, which results in not only higher cost but also an inconvenience of the fact that it will not work when losing one or two screws. Besides, screws will be all over the wire collecting frame panel which is not nice to look at.

SUMMARY

An object of the present invention is to avoid the above-mentioned disadvantage and inconvenience by providing a fixing device to effectively engage and fasten the adapter to the wire collecting frame and reduce the use of screws avoiding the chance of losing them, or even replace all screws with a snap-locking device such that the adapter can be easily installed on or removed from the wire collecting frame. Besides, the fixing device can be colored for an identification purpose.

In accordance with the present invention, an adapter fixing device adapted to fix an adapter on a panel includes an upper member held attached to the panel, a lower member coupled with the upper member for fixing therebetween the adapter, and an engaging device combining together the upper member and the lower member.

The upper member can include a side plate having an engaging piece for being fixed to the panel. The side plate is designed to protect the adapter from damage and prevent it from loosing up.

The upper member can have a hole through which a plug is inserted into the adapter, and an indication can be provided beside the hole for an identification purpose. In addition, the hole can be covered by a cover which is retractably mounted on the upper member.

As regards the lower member, it can include a bunching piece with which connecting wires of the adapter are bunched together, meanwhile, its outer surface can be provided thereon with an index.

The engaging device can include a screw and a screw hole seat wherein the screw hole seat and the upper member are integrally made and the lower member bears a screw hole at a corresponding position to the screw hole seat such that the screw can be screwed to the screw hole seat through the screw hole.

The engaging device can include a protrusion and a corresponding recess wherein the protrusion and the upper member are integrally formed and the recess is formed on and the lower member.

The engaging device can include a tenon and a mortise wherein the tenon and the upper member are integrally formed and the mortise is formed on the lower member.

The engaging device can include pieces respectively formed on the upper and lower members and welded together by ultrasonic wave.

The panel can be a wire collecting frame, a receptacle cover board, or a wall plate.

The present invention may best be understood through the following description with reference to the accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
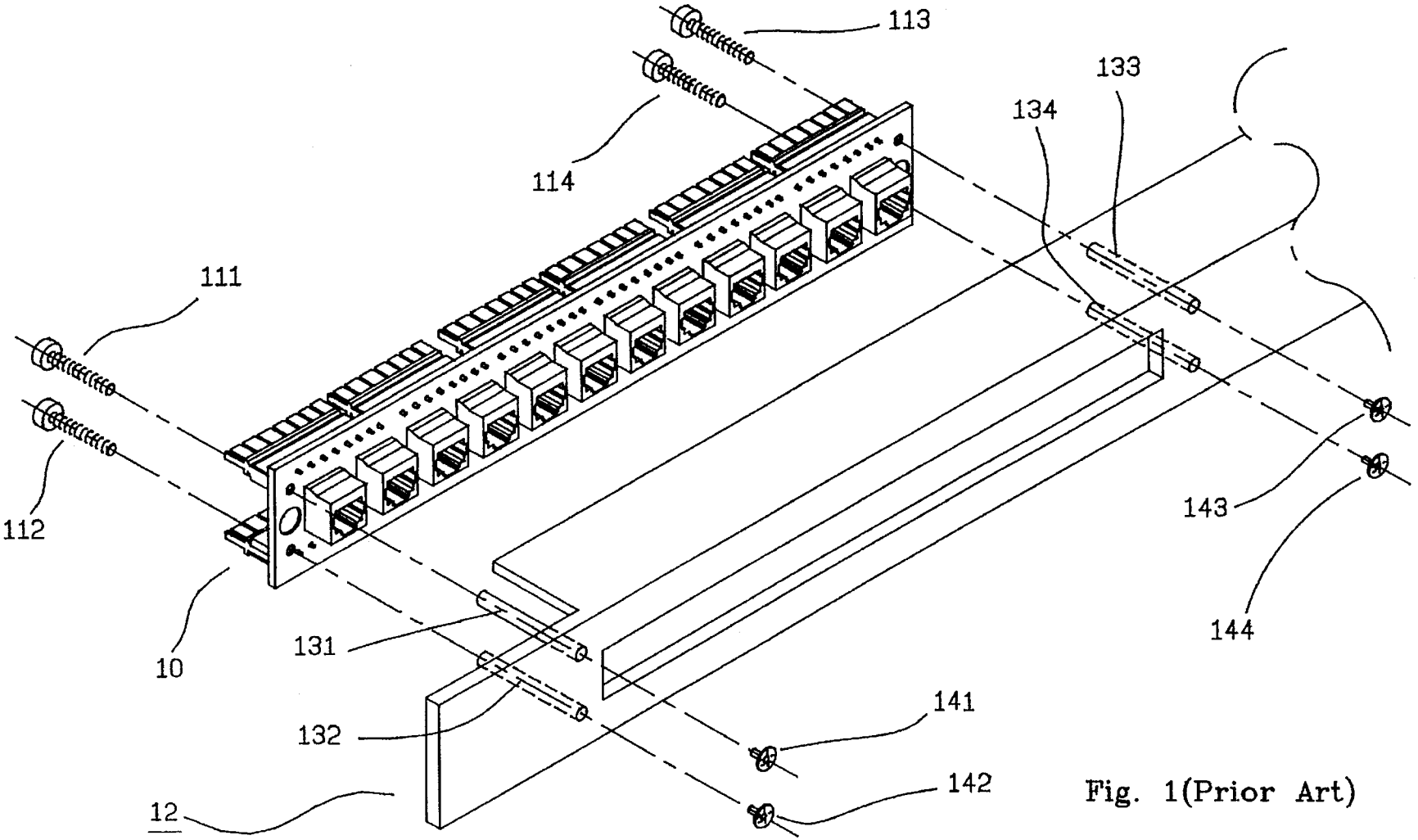
Fig. 1(Prior Art)
FIG. 1 is an exploded view of a prior art embodiment of an adapter and a wire collecting frame.
Figure 2:
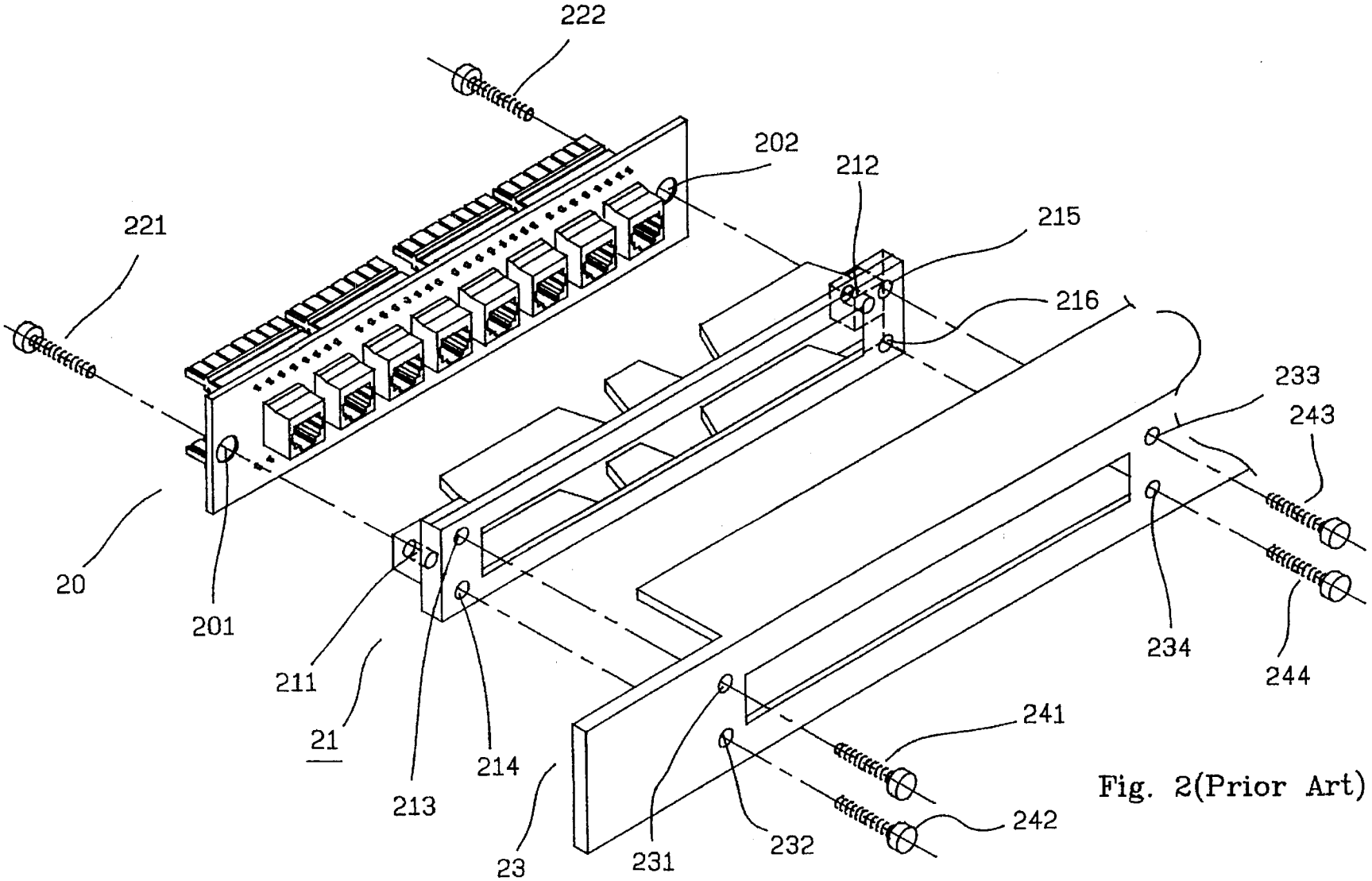
Fig. 2(Prior Art)
FIG. 2 is another exploded view of a prior art embodiment of an adapter and a wire collecting frame.
Figure 3:
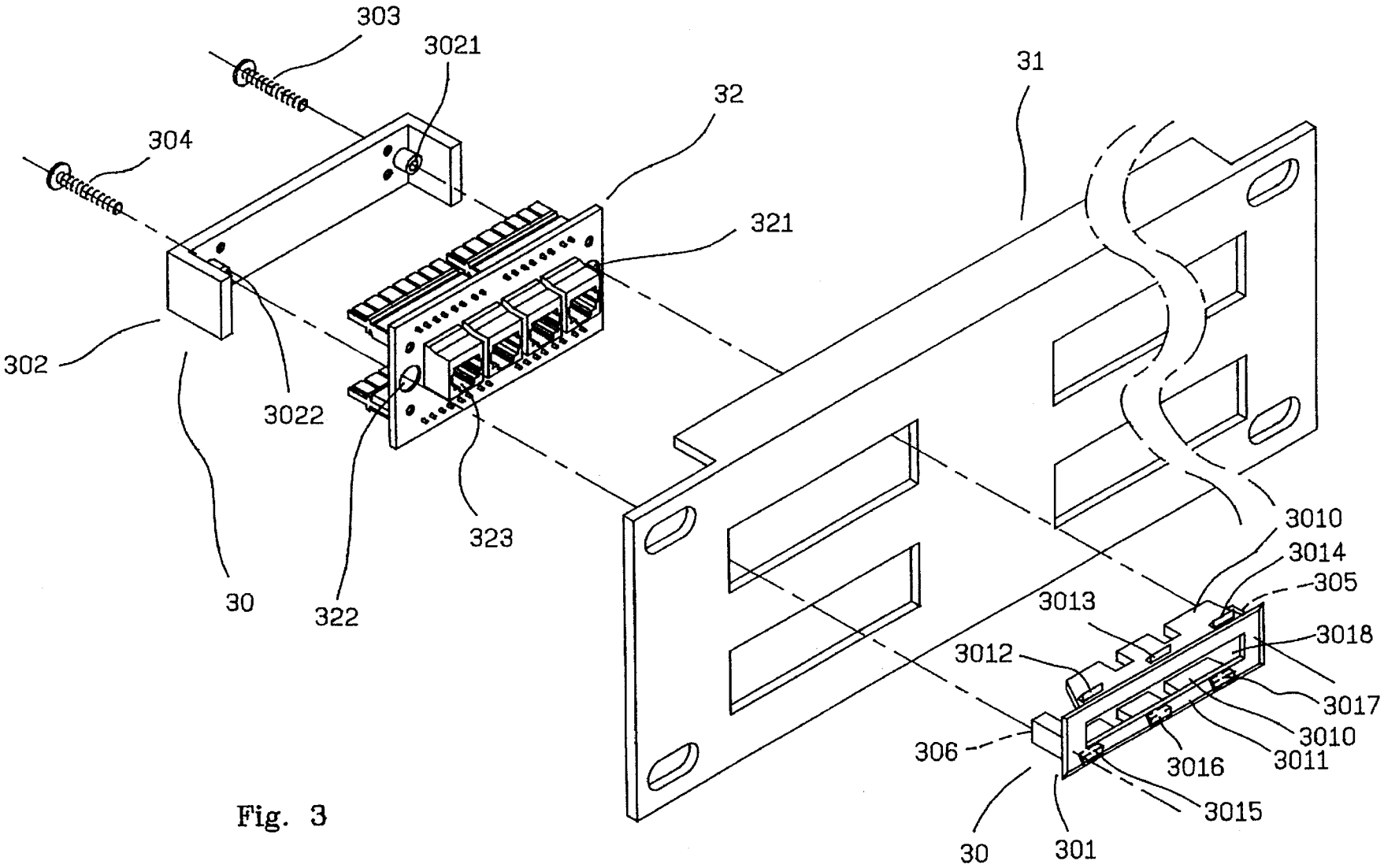
FIG. 3 is an exploded view of a first embodiment of the present invention.

In the preferred embodiment, an adapter fixing device 30 consists of an upper member 301, a lower member 302 and an engaging device 303, 304, 305, and 306, as shown in FIG. 3 where the upper member 301 has a side plate 3011 extending along two sides thereof to form a holding section 3010. The upper member 301 is inserted to the front side of the wire collecting frame 31, and is fixed thereon by using the engaging piece 3012, 3013, 3014, 3015, 3016, 3017 on the holding section 3010 and the side plate 3011. Then the adapter 32 is placed between the holding section 3010 on the upper member 301, covered by the lower member 302 which is a U-shape board, and fixed onto the wire collecting board 31 by the screws 303 and 304 which are screwed through the screw holes 3021 and 3022 on the lower member 302 and screw holes 321 and 322 on the adapter 32 to the screw hole seats 305 and 306 on the two ends of the upper member 301. Furthermore, the side plate 3011 has a hole 3018 facilitating the insertion of a plug into the receptacle 323.

Figure 4:
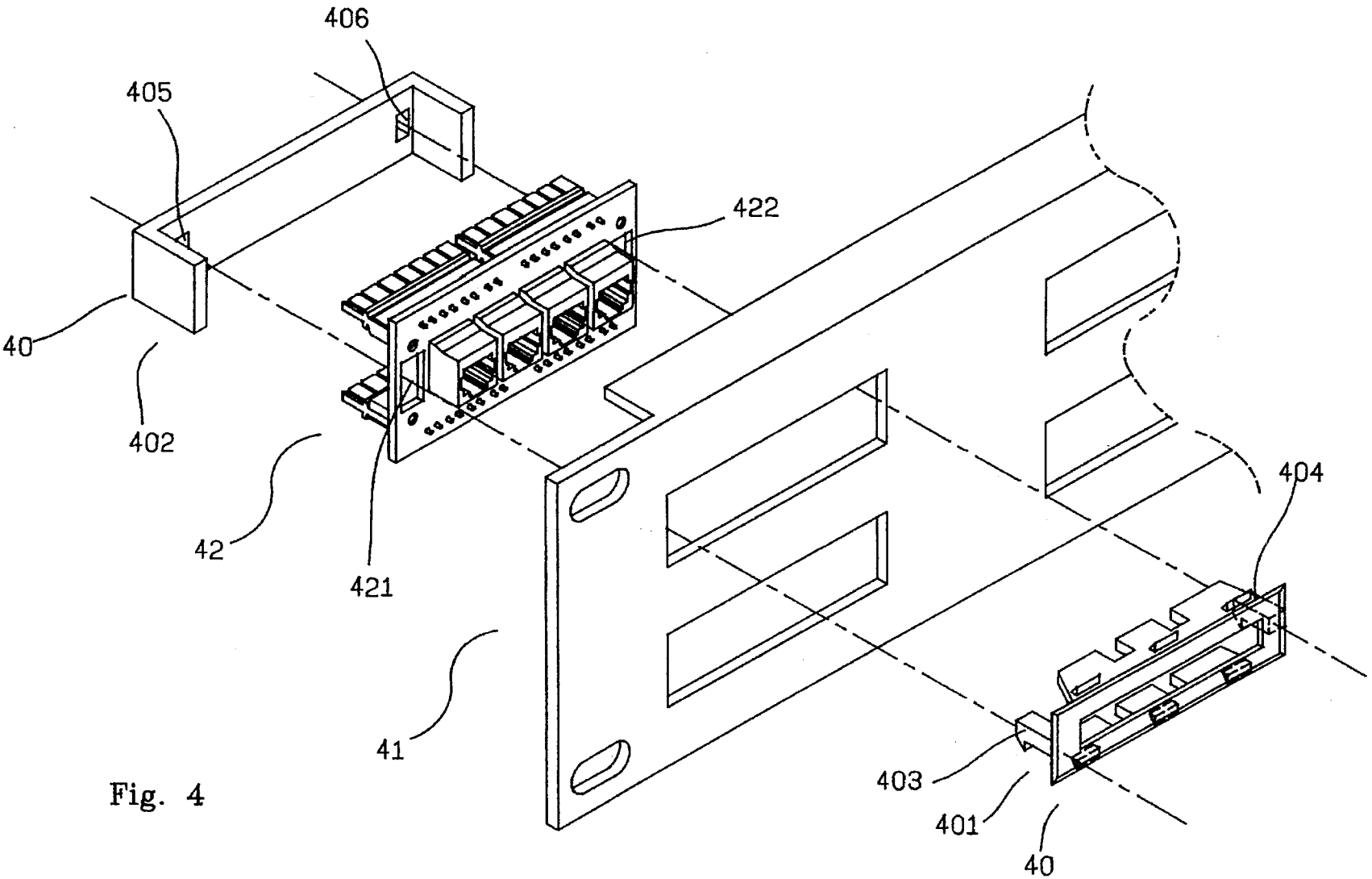
FIG. 4 is an exploded view of a second embodiment of the present invention.

Besides, the engaging device according to the present invention can also be a snap fastener. Referring to FIG. 4, an adapter fixing device 40 has an engaging device which includes two protrusions 403 and 404 integrally formed on the upper member 401 of the fixing device 40, and two recesses 405 and 406 formed on the lower member 402 of the fixing device 40. The protrusions 403 and 404 are respectively inserted through holes 421 and 422 on the adapter 42 and into the recesses 405 and 406 to fasten the adapter 42 to the wire collecting frame 41.

Figure 5:
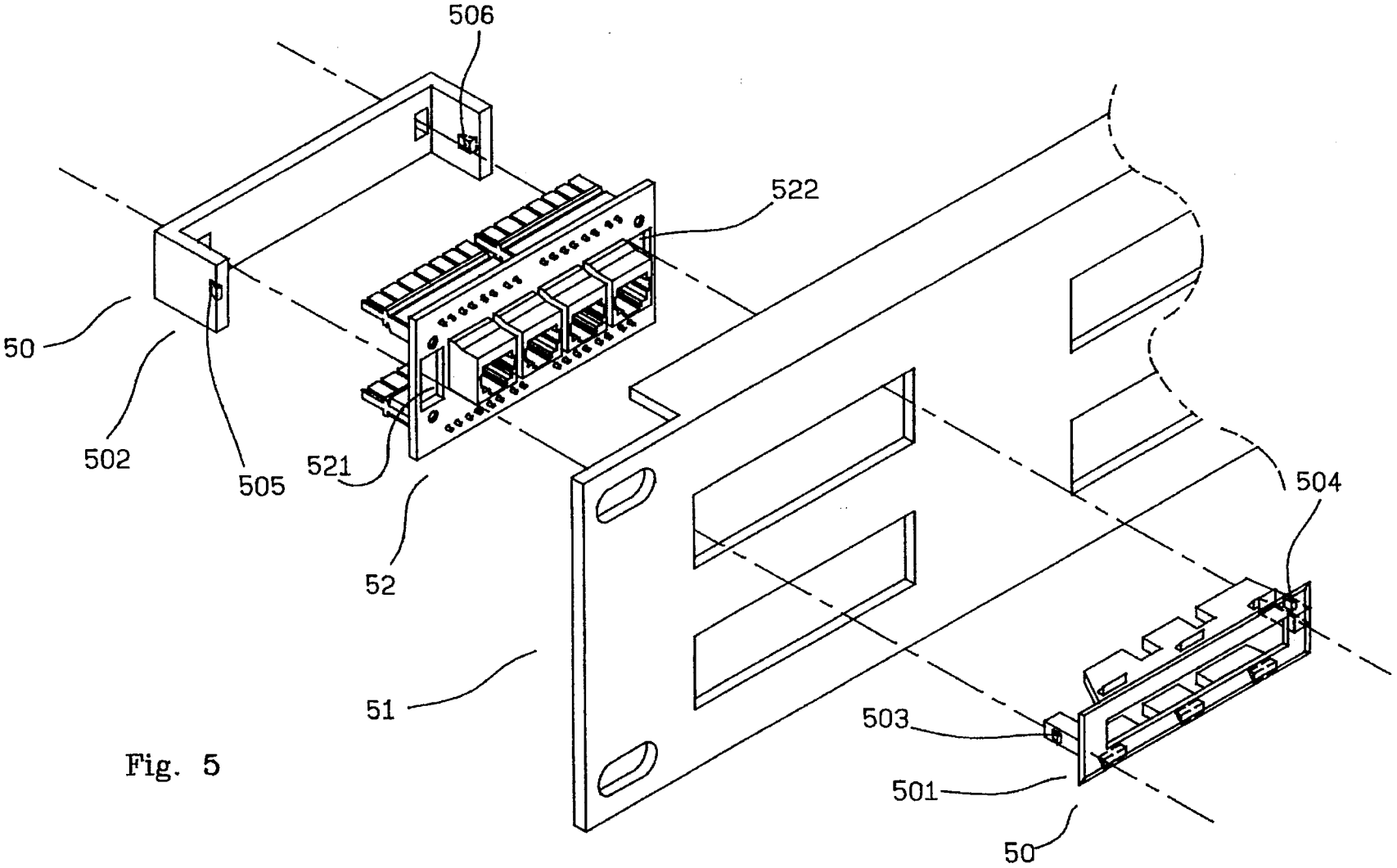
FIG. 5 is an exploded view of a third embodiment of the present invention.

Alternatively, the engaging device 50 can include tenons 503 and 504 which are integrally formed on the upper member 501 and mortises 505 and 506 which are formed on the lower member 501, with reference to FIG. 5. The tenons 503 and 504 enter the holes 521 and 522 on the adapter 52 and slip into the mortises 505 and 506 so as to fasten the wire collecting frame 51 and the adapter 52.

In addition to the above-mentioned engaging methods, the upper member and the lower member of the adapter fixing device can also be engaged by means of ultrasonic welding method.

Figure 6:
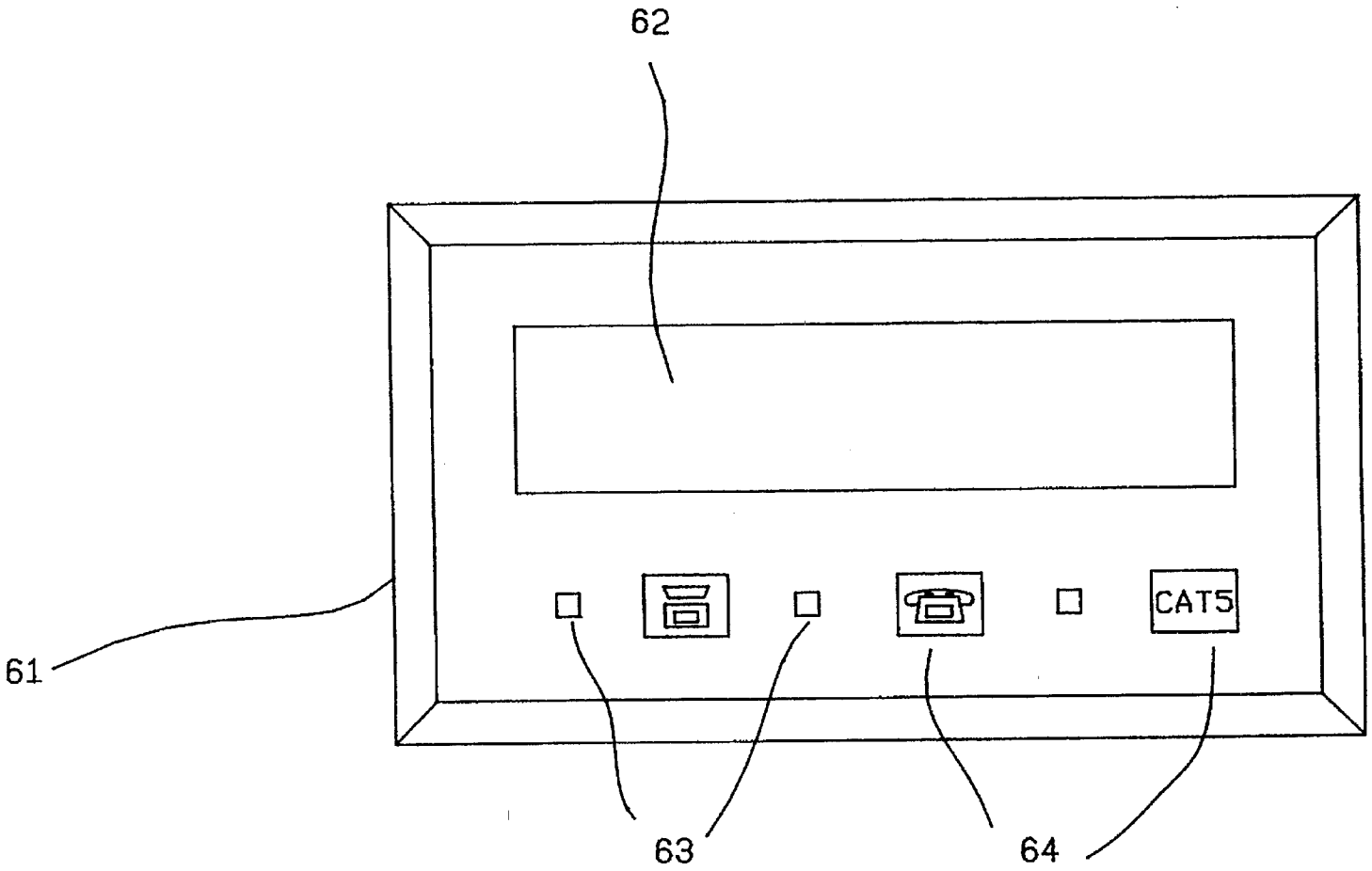
FIG. 6 is a drawing of an embodiment of a side plate according to the present invention.

Moreover, the area of the side plate on the upper member of the fixing device can be enlarged, as shown in FIG. 6 where a side plate 61 can have a hole 62 beside which there is an index hole 63 for inserting therein an index plate for an identification purpose.

Figure 7:
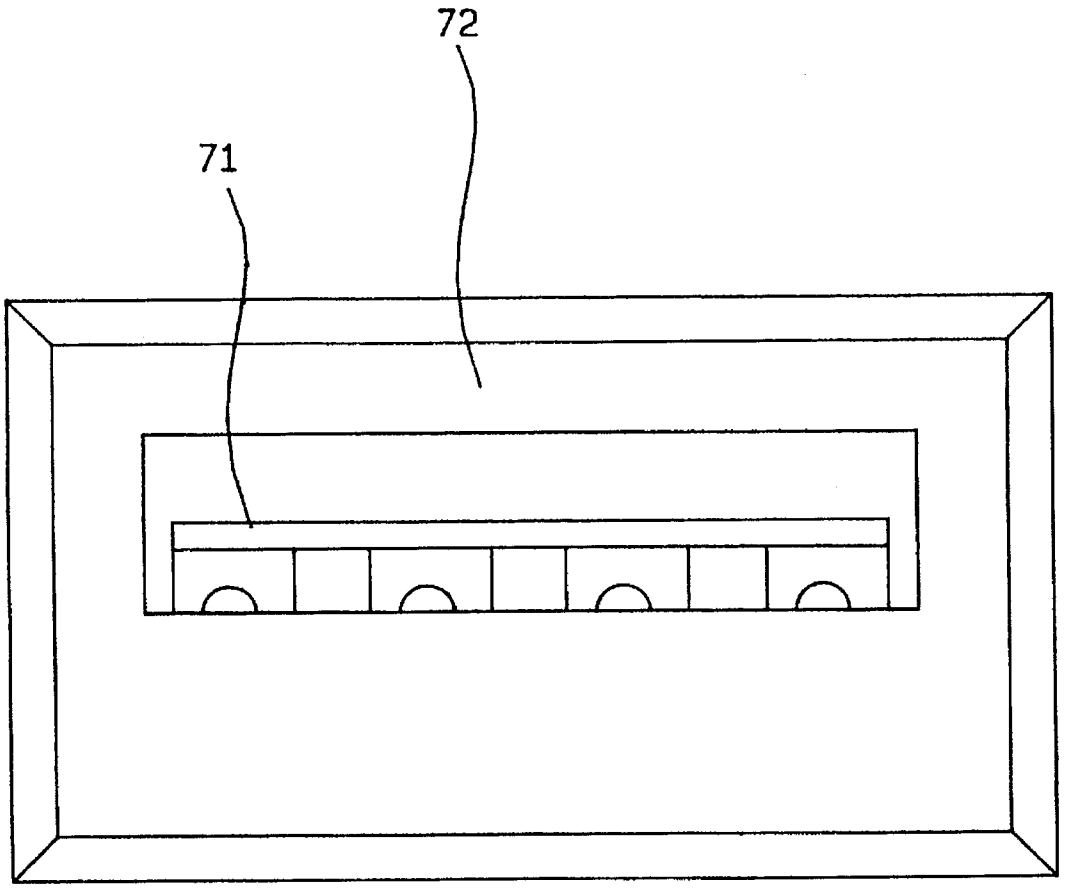
FIG. 7 is a drawing of another embodiment of a side plate according to the present invention.

As shown m FIG. 7, the side plate can be covered by a cover 71 which is retractably mounted on the upper member 72. Such technique is notoriously known in the art, so it will not be detailed here. In this way, the fixing device can keep off dust and other unwanted objects, maintain a nice appearance, and save space for possible expanding of the adapter.

Figure 8:
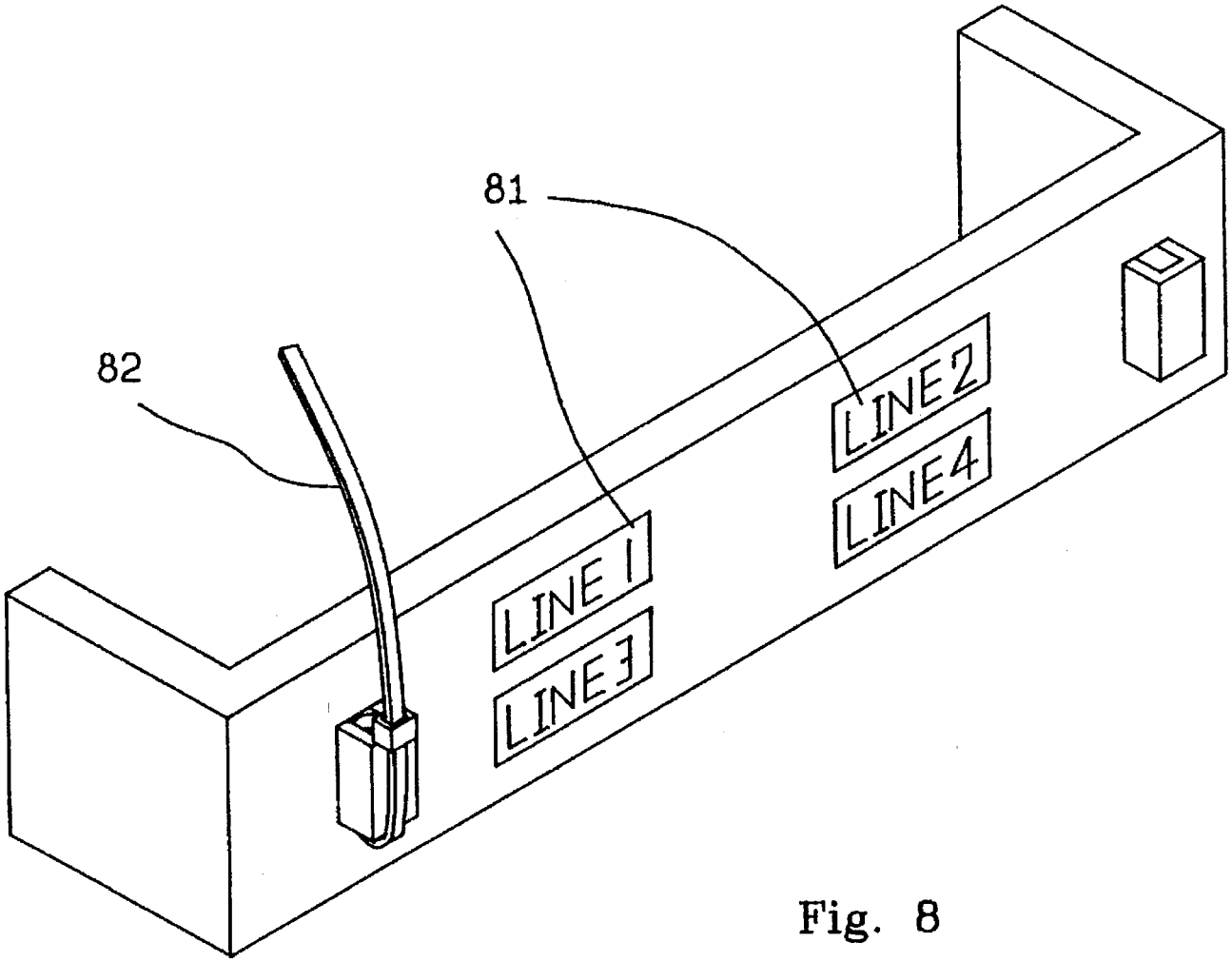
FIG. 8 is a drawing of an embodiment of a lower member according to the present invention.

With reference to FIG. 8, an index 81 can be secure on the outer space of the lower member for an identification purpose. Besides, a bunching piece 82 can be included for bunching all the connecting wires of the adapter together.

Figure 9:
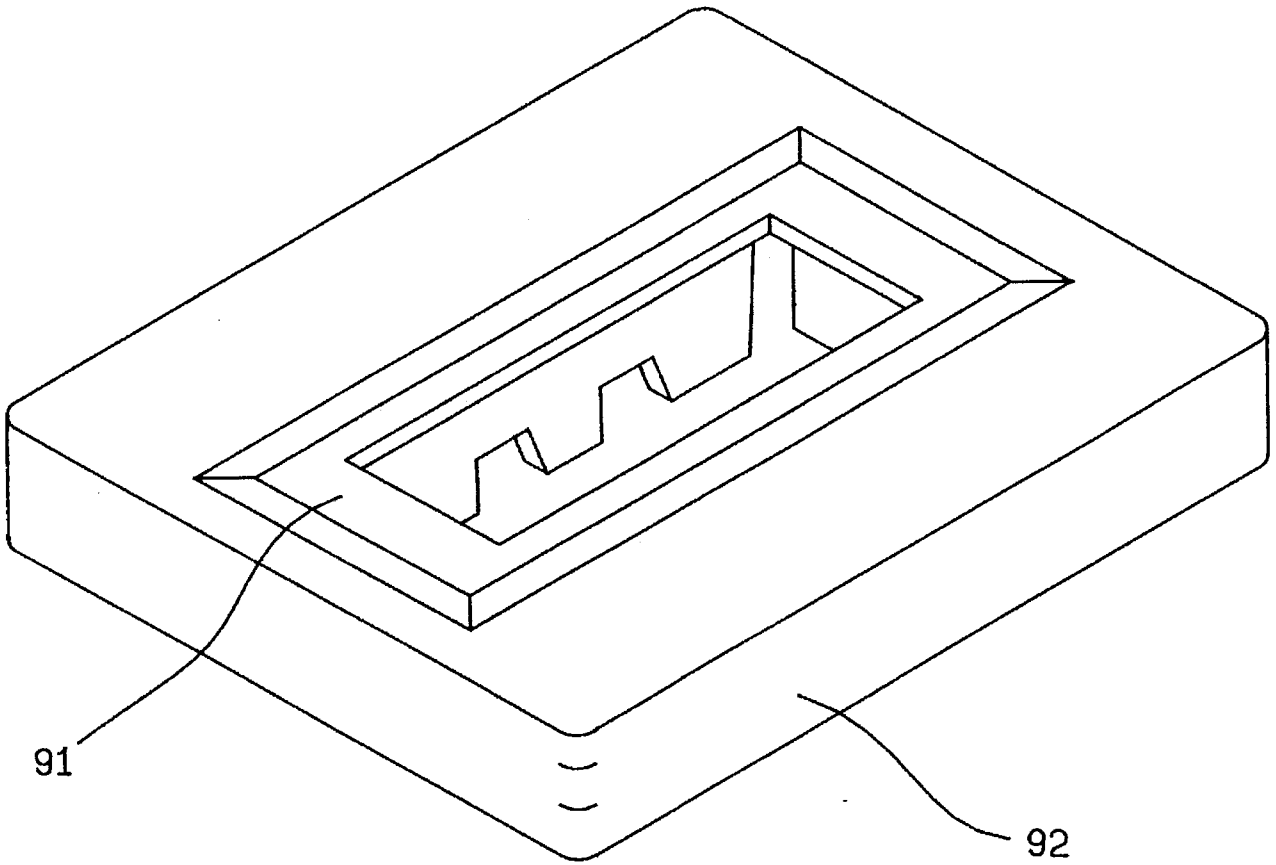
FIG. 9 is a drawing of an embodiment of the present invention.

In addition to the above mentioned application on the wire collecting frame, the present invention can be applied as well as on any other possible place. FIG. 9 shows an embodiment of the application of the fixing device 91 according to the present invention on a wall plate 92.

In a word, the adapter fixing device according to the present invention engages an adapter to a wire collecting frame more effectively and costs less than other device using the prior art does. Nevertheless, the design of the present invention reduces the use of screws or even abandons screws which lowers the chance of losing screws. Also, the fixing device can be made in many sizes to comply with adapters of different sizes in addition to that an index can be added to the fixing device for identification. People skilled in the art will readily appreciate the design.

While the present invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A telephone/computer network adapter panel combination comprising:

a panel;

a telephone/computer network adapter; and an adapter fixing device fixing said telephone/computer network adapter to said panel and including:

an upper member held attached to said panel and having:

a side plate having a holding section having an engaging piece for being directly fixed to said panel, and a hole through which a plug is inserted into said adapter;

a lower member coupled with said upper member for fixing therebetween said adapter; and an engaging device combining together said upper member and said lower member.

2. A combination as claimed in claim 1 wherein said upper member includes two said holding sections housing therebetween said adapter.

3. A combination as claimed in claim 1 wherein an indication is provided beside said hole for an identification purpose.

4. A combination as claimed in claim 1 wherein said upper member retractably mounting thereon a cover for covering said hole.

5. A combination as claimed in claim 1 wherein said lower member bears a bunching piece with which connecting wires of said adapter are bunched together.

6. A combination as claimed in claim 1 wherein an index is provided on an outer surface of said lower member.

7. A combination as claimed in claim 1 wherein said engaging device includes a screw and a screw hole seat.

8. A combination as claimed in claim 7 wherein said screw hole seat and said upper member are integrally made.

9. A combination as claimed in claim 7 wherein said lower member bears a screw hole at a corresponding position to said screw hole seat such that said screw can be screwed to said screw hole seat through said screw hole.

10. A combination as claimed in claim 1 wherein said engaging device includes a protrusion and a corresponding recess.

11. A combination as claimed in claim 10 wherein said protrusion and said upper member are integrally formed.

12. A combination as claimed in claim 10 wherein said recess is formed on said lower member.

13. A combination as claimed in claim 1 wherein said engaging device includes a tenon and a mortise.

14. A combination as claimed in claim 13 wherein said tenon and said upper member are integrally formed.

15. A combination as claimed in claim 13 wherein said mortise is formed on said lower member.

16. A combination as claimed in claim 1 wherein said engaging device includes pieces respectively formed on said upper and lower members and welded together by ultrasonic wave.

17. A combination as claimed in claim 1 wherein said panel is a wire collecting frame.

18. A combination as claimed in claim 1 wherein said panel is a receptacle cover board.

19. A combination as claimed in claim 1 wherein said panel is a wall plate.

* * * * *